US009578950B2

(12) United States Patent
Kamboj

(10) Patent No.: US 9,578,950 B2
(45) Date of Patent: Feb. 28, 2017

(54) MULTIPLE COSMETIC HOLDER AND APPLICATOR

(71) Applicant: Ejaz Kamboj, Las Vegas, NV (US)

(72) Inventor: Ejaz Kamboj, Las Vegas, NV (US)

( * ) Notice: Subject to any disclaimer, the term of this patent is extended or adjusted under 35 U.S.C. 154(b) by 0 days.

(21) Appl. No.: 15/053,281

(22) Filed: Feb. 25, 2016

(65) Prior Publication Data

US 2016/0166048 A1 Jun. 16, 2016

Related U.S. Application Data

(63) Continuation of application No. 14/946,722, filed on Nov. 19, 2015.

(60) Provisional application No. 62/081,980, filed on Nov. 19, 2014, provisional application No. 62/109,545, filed on Jan. 29, 2015.

(51) Int. Cl.

| | |
|---|---|
| ***A45D 33/28*** | (2006.01) |
| ***A45D 40/24*** | (2006.01) |
| ***A45D 34/00*** | (2006.01) |
| ***A45D 34/04*** | (2006.01) |
| ***A45D 40/06*** | (2006.01) |
| ***A45D 40/02*** | (2006.01) |
| ***A45D 40/20*** | (2006.01) |
| *A45D 40/00* | (2006.01) |

(52) U.S. Cl.

CPC ..... *A45D 40/24* (2013.01); *A45D 34/00* (2013.01); *A45D 34/04* (2013.01); *A45D 40/02* (2013.01); *A45D 40/06* (2013.01); *A45D 40/20* (2013.01); *A45D 2034/005* (2013.01); *A45D 2040/0031* (2013.01); *A45D 2040/0062* (2013.01)

(58) Field of Classification Search

CPC ..... A45D 40/24; A45D 40/06; A45D 40/20; A45D 40/02; A45D 40/23; A45D 40/08; A45D 40/205; A45D 34/00; A45D 34/06; A45D 2034/005; A45D 2040/0031; A45D 2040/0062; A45D 2040/00; A45D 2040/0025

USPC ..... 221/119–212

See application file for complete search history.

(56) References Cited

U.S. PATENT DOCUMENTS

| | | | |
|---|---|---|---|
| 1,623,509 | A | 4/1927 | Vivadou |
| 2,142,312 | A | 1/1939 | Heinz |
| 3,001,531 | A | 9/1961 | Gazdik |
| 3,320,962 | A | 5/1967 | Moriber et al. |
| 5,109,877 | A | 5/1992 | Takeda |

(Continued)

FOREIGN PATENT DOCUMENTS

WO WO 2011/095763 A1 8/2011

*Primary Examiner* — Rachel Steitz

(74) *Attorney, Agent, or Firm* — Weide & Miller, Ltd.

(57) ABSTRACT

A multiple cosmetic holder and applicator includes a plurality of cosmetic cartridges that receive standard cosmetics therein. The cartridges include an upper magnet disposed within the opening, and a lower annular groove on the cylindrical body. A main body holds the plurality of cosmetic cartridges and includes a base with depressions which include a lower magnet therein and which receive the cosmetic cartridges, locking mechanisms which interface with the annular groove of the cartridges to lock the cartridges within the depressions, and an outer case movable relative to the main body which has a pressable button that unlocks the locking mechanism from the cartridge. A removable cap covers the main body, the cartridges, and the standard cosmetics. A selector tube extends through an aperture in the cap to remove the cartridge when the button is pressed and the locking mechanism is unlocked.

20 Claims, 12 Drawing Sheets

(56) References Cited

U.S. PATENT DOCUMENTS

| | | | |
|---|---|---|---|
| 6,540,422 | B2 | 4/2003 | Torii |
| 6,895,628 | B1 | 5/2005 | Anderson |
| 8,231,294 | B2 | 7/2012 | Grossnass et al. |
| 8,579,529 | B2 | 11/2013 | Pechko et al. |
| 8,662,776 | B2 | 3/2014 | Porter et al. |
| 2007/0280772 | A1 | 12/2007 | Mika |
| 2009/0232579 | A1 | 9/2009 | Obereisenbuchner et al. |

MULTIPLE COSMETIC HOLDER AND APPLICATOR

CROSS REFERENCE TO RELATED APPLICATIONS

This application is a continuation of U.S. application Ser. No. 14/946,722 which was filed on Nov. 19, 2015, which claims priority to U.S. Provisional Application No. 62/081,980 filed Nov. 19, 2014 and U.S. Provisional Application No. 62/109,545 filed Jan. 29, 2015, the contents of which are hereby incorporated by reference.

BACKGROUND

1. Field

The disclosed embodiments relate to cosmetic holders and applicators. More specifically, the disclosed embodiments relate to cosmetic holders with a plurality of cosmetics and applicators utilizing at least one of the plurality of cosmetics.

2. Related Art

Cosmetics and cosmetic applicators come in a variety of colors and packaging. Users often prefer to have access to a number of different cosmetics in order to have a desired color or cosmetic for a particular occasion. Many users of cosmetics thus accumulate a number of different cosmetics in a number of different colors.

When many different colors of cosmetics are accumulated, it may become difficult for a user to store all of the acquired cosmetics. Furthermore, it may be difficult to find a desired color amidst the many cosmetics. As each cosmetic generally comes with an applicator, the amount of storage required for the cosmetics may increase.

SUMMARY

Given the above problems, there is a need to efficiently provide a number of cosmetics in a convenient manner that allow a user to easily find and use a desired cosmetic and to decrease required storage space. This should also be accomplished while maintaining the fashion and attractiveness of the cosmetic and cosmetic applicator.

The disclosed embodiments have been developed in light of the above problems and aspects of the invention may include a multiple cosmetic holder and applicator that comprises a housing including a base end and an applicator end. A base end cover is disposed at the base end and an applicator end cover is disposed at the applicator end. The applicator end cover may be removable. The applicator may further comprise a plurality of outer positioners and a center positioner disposed on an inner surface of the base end cover, the plurality of positioners being configured to hold and position at least one cosmetic cartridge, the cosmetic cartridge being moveable between the positioners.

Further, an applicator member may be defined by a cylindrical body that is moveable relative to the housing. The applicator end cover may have an aperture through which the applicator member may move. A base end of the applicator member selectively connects to one of the cosmetic cartridges. In this manner, when the applicator member is moved out of the housing while being connected to the cosmetic cartridge, the cosmetic cartridge is positioned to apply a cosmetic. Alternatively, when the applicator member is moved out of the housing while not being connected to the cosmetic cartridge, the cosmetic cartridges may be moved from one of the outer positioners onto the center positioner.

According to another exemplary embodiment, a multiple cosmetic holder and applicator includes a plurality of cosmetic cartridges. The cosmetic cartridges may each comprise a cylindrical body having an opening to receive a standard cosmetic, an upper lip protruding from the cylindrical body, an upper magnet disposed within the opening, and a lower annular groove on the cylindrical body.

The cosmetic holder may further comprise a main body configured to hold the plurality of cosmetic cartridges. The main body may include a base having a plurality of depressions in which a lower magnet is disposed, the plurality of depressions being configured to receive the cosmetic cartridges therein. The base may further include a plurality of locking mechanisms disposed adjacent to the plurality of depressions, the plurality of locking members configured to interface with the lower annular groove of the cartridges to selectively lock the cartridges within the depressions. The base may also include an outer case disposed around the main body. The outer case is movable relative to the main body to one of a number of predetermined positions. The outer case may comprise a pressable button. When pressed, the button may interface with one of the locking mechanisms to unlock the locking mechanism from the annular groove.

The cosmetic holder may also include a removable cap disposed on the main body that is configured to cover the main body, the cartridges, and the standard cosmetics. The removable cap may comprise an aperture in the top surface thereof. A selector tube may be included to extend through the aperture and over a selected one of the standard cosmetics. The selector tube interfaces with the upper lip of the cartridge in a friction fit to remove the cartridge with the standard cosmetic when the button is pressed and the locking mechanism is unlocked.

In some embodiments, the upper magnet may center the cartridge within the depression via a magnetic force with the lower magnet disposed in the base. In further embodiments, the main body may also comprise a main body top disposed above the base. The main body top covers the locking mechanism, and may include apertures corresponding to the plurality of depressions within the base.

In some embodiments, the locking mechanism is a lever configured to rotate about a pin. The lever may comprise a downward projection that extends outward from the main body. The button may be configured to actuate the downward projection by pressing against the downward projection to move the lever. The locking mechanism may also comprise a biasing spring. The biasing spring may bias the downward projection towards an outer surface of the base rotating the lever into a locked position within the annular groove.

In some embodiments, the cosmetic holder may include four cartridges. In other embodiments, more or less cartridges than four may be included.

In some instances, the base may comprise a cutout disposed in an outer surface therein. A seating spring may be disposed within the cutout, and a ball bearing may be disposed within the cutout at an outer end of the spring. The outer case may comprise a plurality of indents along an inner surface thereof. The ball bearing is biased outward against the inner surface of the outer case to bias the ball bearing into one of the plurality of indents to seat the base at one of a plurality of positions relative to the outer case. This allows access to one of the plurality of cosmetics held therein.

The standard cosmetics which may be held in such a cosmetic holder may comprise one or more of a lipstick, lip gloss, lip balm, pencil, brush, liner, or other cosmetic.

In other exemplary embodiments, a multiple cosmetic holder and applicator comprises a plurality of slots configured to hold a standard cosmetic. The plurality of slots may each have a flexible c-shaped wall. The flexible c-shaped walls may be flared at the outer edges thereof. Connection welds on rear portions of each of the plurality of slots may connect the rear portions of the plurality of slots together. The cosmetics may be removable from the slots, may slide within the slots, and may extend beyond a top and/or a bottom of the slots.

In some embodiments, the multiple cosmetic holder and applicator may also have a base connected to the bottom of the slots and a cap covering the plurality of slots and cosmetics. The cap may be removably attached to the base. In other embodiments, the multiple cosmetic holder and applicator may have a belt connected to one of the plurality of slots, the belt surrounding the slots and attaching to itself via a fastener. The width of the belt may be equal to the height of the slots, or the width may be less than the height of the slots to allow the user to slide the cosmetic within the slot without removing the belt.

The above described embodiments provide a system that effectively organizes, stores, and allows easy application of multiple cosmetics. The holder may be built to be petite and to fit within a purse or other bag, to be part of a set (such as on a vanity table) and the like. The device also is of a robust design, while avoiding substantial manufacturing costs.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

Figure 1:
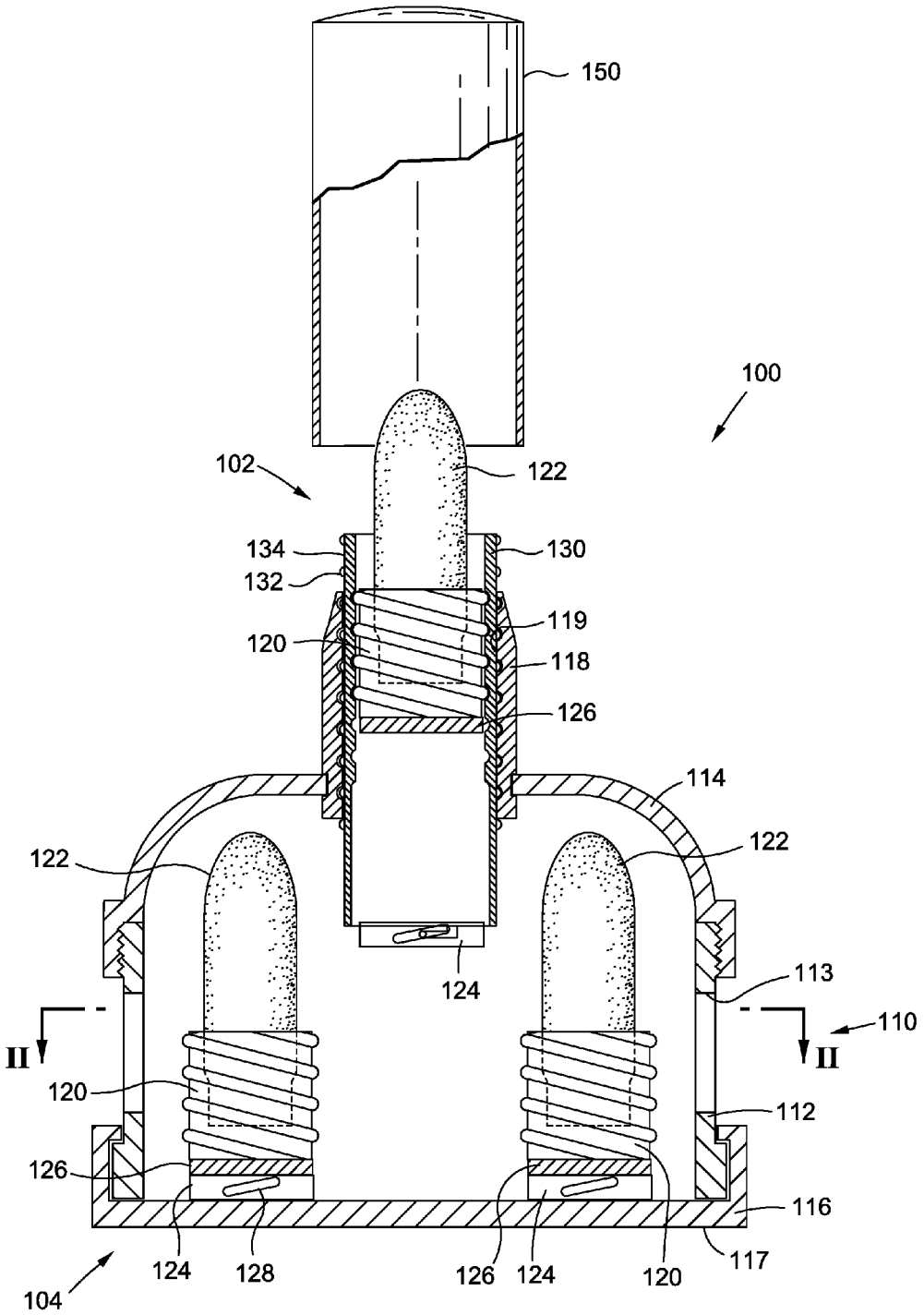
FIG. 1 shows a cut away view of the multiple cosmetic holder and applicator according to one exemplary embodiment.

FIG. 1 shows a cut away view of the multiple cosmetic holder and applicator according to one exemplary embodiment. In FIG. 1, a multiple cosmetic holder and applicator 100 is shown that has an applicator end 102 and a base end 104. The cosmetic holder and applicator 100 includes a housing 110 that houses a plurality of cosmetic cartridges 120.

The housing 110 includes an outer shell 112 that wraps around an outer circumference of the housing 110. The housing 110 further includes a base cover 116 and an applicator end cover 114. The base cover 116 may be permanently or removably attached to the outer shell 112 by way of any suitable connection including fasteners, threads, snap-fit, interference fit, adhesives, etc. In one embodiment, the base cover 116 may be at least partially formed from a magnetically attractable material. Further, in one embodiment, the base cover 116 has an outer surface 117 that is configured to be reflective so as to operate as a mirror.

The applicator end cover 114 is configured to be removable from the outer shell 112 to allow access within the housing 110. The applicator end cover 114 may be connected to the outer shell 112 by threads, fasteners, a key-fit, or the like. In this manner, the plurality of cosmetic cartridges 120 may be accessed to be removed or replaced with another cosmetic cartridge 120. In this embodiment, the applicator end cover 114 is removable while the base cover 116 is permanently attached. However, the applicator end cover 114 may be permanently affixed to the housing 110 and the base cover 116 may be removable.

The applicator end cover 114 includes an applicator protrusion 118. The applicator protrusion 118 is disposed in the center of the applicator end cover 114 and extends toward the applicator end 102 of the cosmetic holder and applicator 100. The applicator protrusion 118 may be a cylindrical member that defines a through hole on the inner surface 119 of the protrusion 118. The through hole allows a cosmetic cartridge 120 to pass through for application of a cosmetic 122 by a user, which will be described in more detail below. In one embodiment, the applicator protrusion 118 may be movable relative to the applicator end cover 114. That is, the applicator protrusion 118 may rotate about its axis relative to the applicator end cover 114.

Figure 2:
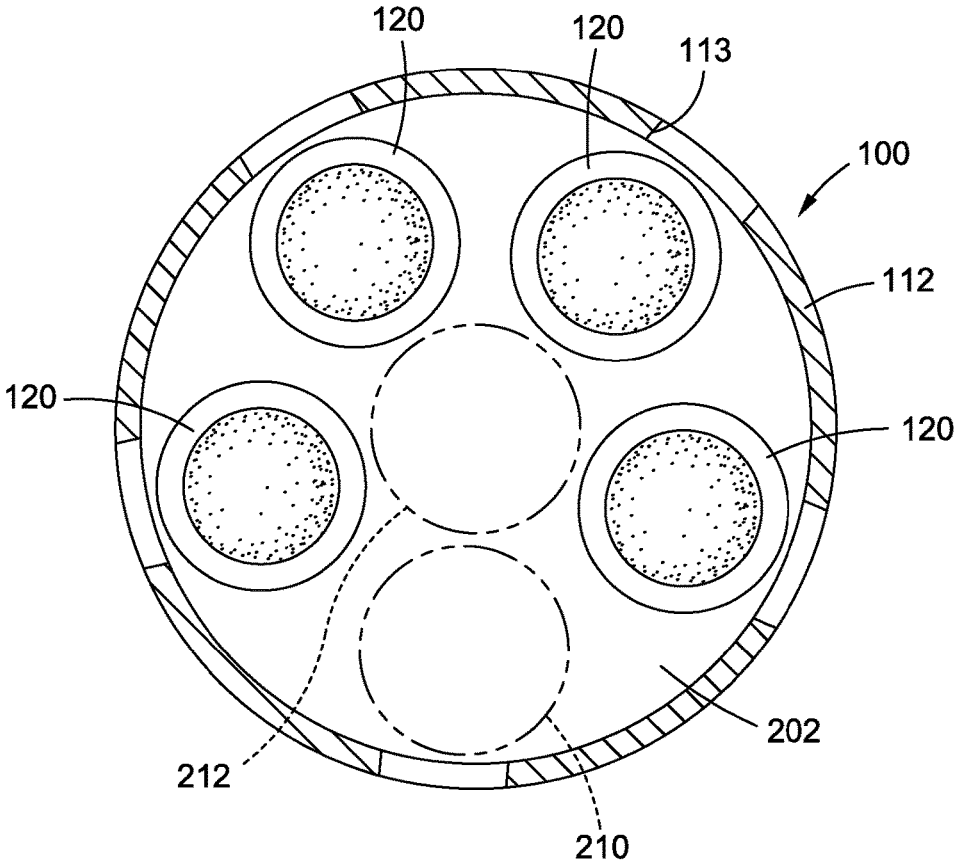
FIG. 2 shows a top section view of the multiple cosmetic holder and applicator of FIG. 1.

FIG. 2 is a top section view of the multiple cosmetic holder and applicator of FIG. 1. As shown in FIG. 2, an inner surface 202 of the base cover 116 includes a plurality of outer cartridge positioners 210 and a center cartridge positioner 212. The plurality of outer cartridge positioners 210 are configured to surround the center cartridge positioner 212.

Each of the center positioner 212 and outer positioners 210 are configured to hold a cosmetic cartridge 120 in place. Each of the cosmetic cartridges 120 holds a cosmetic 122 such as a lipstick, pencil, sponge, a liquid container, or the like. In one embodiment, the cartridges 120 may each hold a different color of a lipstick.

Each of the center positioner 212 and the outer positioners 210 are configured such that the cosmetic cartridge 120 is removable from the positioners 210, 212. In this manner, the multiple cosmetic holder and applicator 100 may be loaded with various cosmetic cartridges 120 based on a user's preference. Further, the cosmetic cartridges 120 may be movable from one positioner 210, 212 to another positioner 210, 212.

For example, the base cover 116 may be formed such that each of the positioners 210, 212 may comprise a magnet or magnetically attracted material. The positioners 210, 212 may further be formed as indents on inner surface 202 of the base cover 116. The positioners 210, 212 may thus both align the cartridges 120 into position as well as hold them in place. The cosmetic cartridges 120 may each include an anchor 124 that also comprises a magnet or a magnetically attracted material. The anchor 124 is disposed on a base end of the cartridges 120 and thus allows the cartridges 120 to releasably attach to the positioners 210, 212.

The cosmetic cartridges 120 are configured to move from one positioner 210, 212 to another such that the user may access a desired cartridge 120. In this embodiment, the outer shell 112 includes a plurality of apertures 113. The plurality of apertures 113 are disposed about the outer shell 112 to correspond with the locations of the outer positioners 210. The plurality of apertures 113 allow a user to manipulate the cosmetic cartridges 120 within the housing 110 to move the cartridges 120 from one of the positioners 210, 212 to another positioner 210, 212. For example, when the user identifies one of the cosmetics 122 to be applied, the user manipulates the cartridge 120 with the identified cosmetic 122 onto the center positioner 212. If another cartridge 120 is already on the center positioner 212, it may be pushed off onto one of the outer positioners 210 while other cartridges 120 in turn are moved so that each cartridge 120 within the housing 110 is located on a positioner 210, 212.

The multiple cosmetic holder and applicator 110 further includes a movable applicator member 130. The applicator member 130 may be of a cylindrical shape and is configured to move relative to the housing 110 through the applicator protrusion 118. The applicator member 130 may move through the applicator protrusions 118 in any suitable manner including sliding or, as shown in FIG. 1, by threads 132 on an outer surface 134 of the member 130 that correspond with threads on the inner surface 119 of the protrusion 118.

Figure 3A:
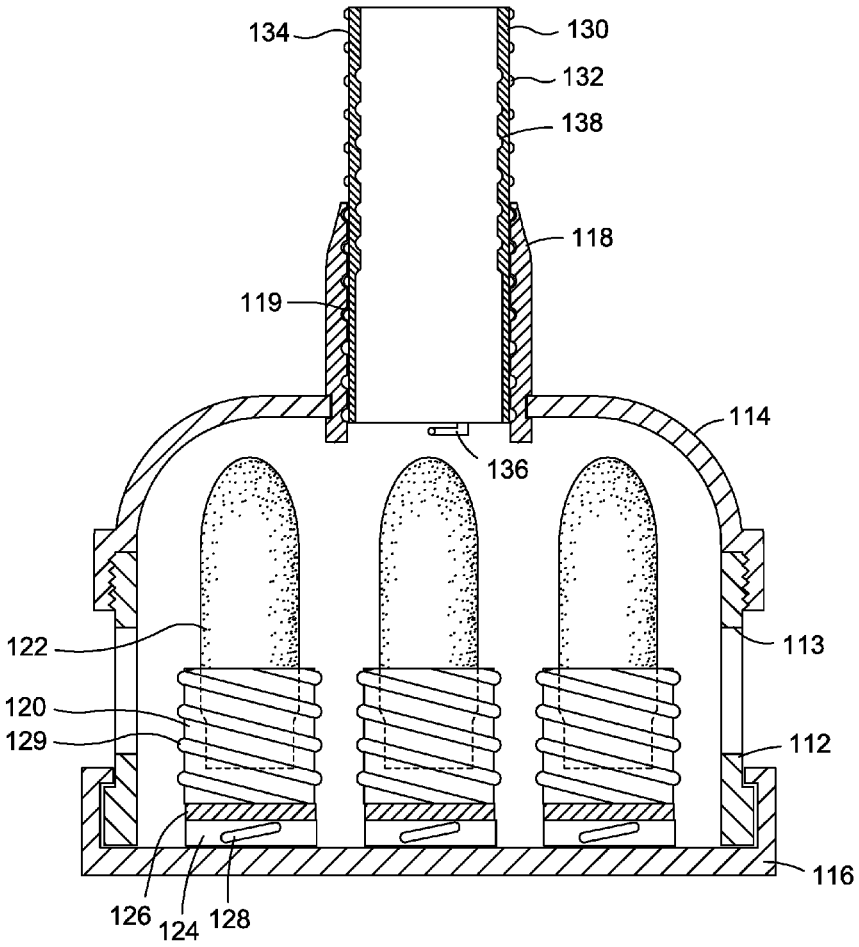
FIG. 3A shows the multiple cosmetic holder and applicator of FIG. 1 with an applicator member in an extended position.
Figure 3B:
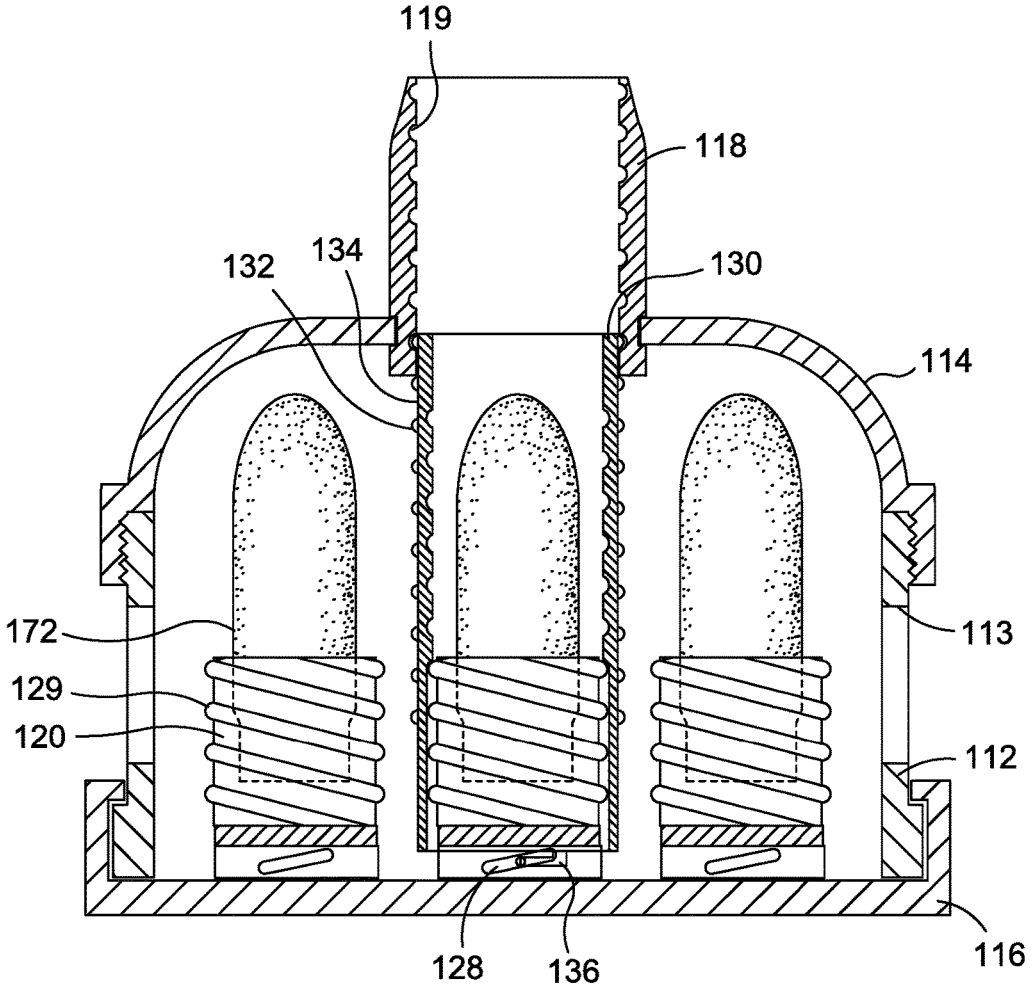
FIG. 3B shows the multiple cosmetic holder and applicator of FIG. 1 with the applicator member in a retracted position.
Figure 3C:
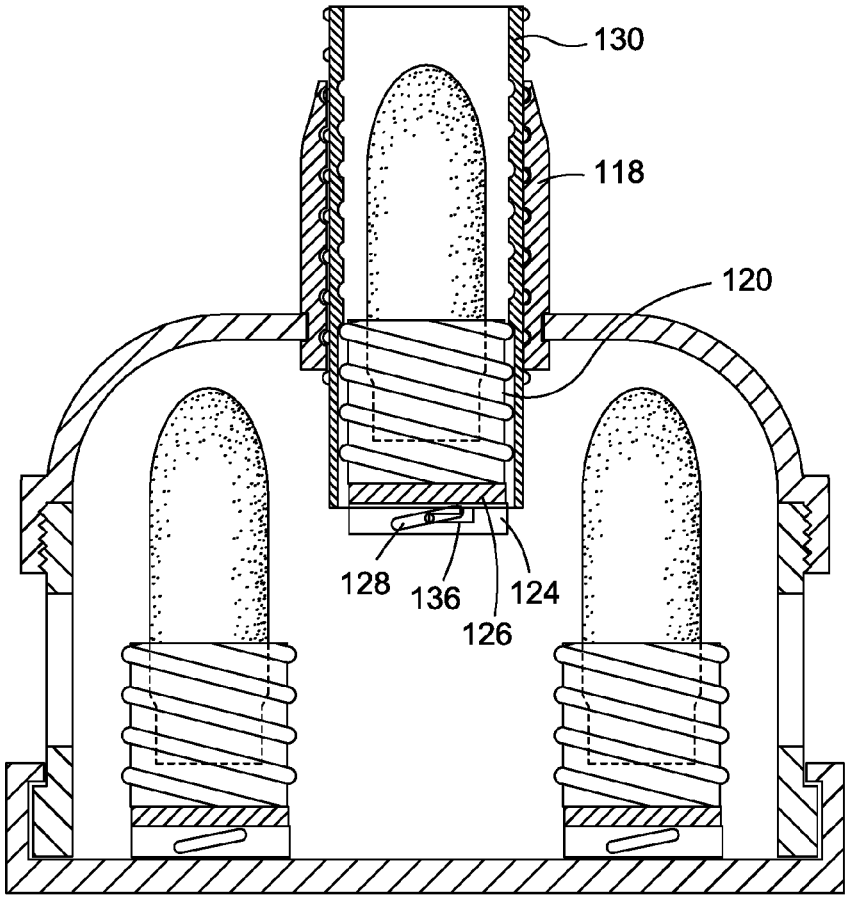
FIG. 3C shows the multiple cosmetic holder and applicator of FIG. 1 with an applicator member anchored to a cosmetic cartridge.

The applicator member 130 moves through the protrusion 118 to transport cosmetic cartridges 120 into position for application of the cosmetic 122, and to allow the user to manipulate the cosmetic cartridges 120 within the housing 110. FIGS. 3A-3C show the multiple cosmetic holder and applicator with an applicator member in a plurality of positions.

As shown in FIG. 3A, the applicator member 130 is moved to an extended position so as to project from the protrusion 118 at the applicator end 102. In another embodiment, the applicator member 130 may be completely removed from the housing 110. While the applicator member 130 is in the position shown in FIG. 3A, a cartridge 120 in one of the outer positioners 210 may be moved onto the center positioner 212. If a cosmetic cartridge 120 currently occupies the center positioner 212, then the cartridge 120 may be pushed out of the center positioner 212 to an outer positioner 210. The other cartridges 120 may then move from one outer positioner 210 to another outer positioner 210 to facilitate the cartridge 120 that moved onto the center positioner 212. That is, with the applicator member 130 removed from the housing 110 as shown in FIG. 3A, the cosmetic cartridges 120 may be freely manipulated to different positions within the housing 110.

Once a desired cosmetic cartridge 120 is disposed onto the center positioner 212, the applicator member 130 may be moved relative to the housing 110 toward the base end 104 such that the desired cosmetic cartridge 120 is disposed within the applicator member 130, as shown in FIG. 3B. The applicator member 130 has a keyed protrusion 136 that extends from the base end of the member 130. The anchor 124 of each cartridge 120 may comprise a corresponding groove 128 to receive the keyed protrusion 136. In one embodiment, the keyed protrusion 136 may be inserted into the groove 128 when the member 130 in the retracted position is twisted in a predetermined direction.

When the protrusion 136 is inserted into to the groove 128, the applicator member 130 is attached to the cartridge 120. In this manner, as shown in FIG. 3C, the applicator member 130 may be raised with the cosmetic cartridge 120 so that the cosmetic 122 may be applied by user.

In the above embodiment, the applicator member 130 engages with the anchor 124 by way of a keyed protrusion 136 and groove 128. However, the invention is not limited to this. The applicator member 130 may engage with the anchor in any of a variety of suitable manners including a lever actuated locking mechanism such as a clamping mechanism, an actuating pin that is received in a corresponding hole, and the like.

In this embodiment, the applicator member 130 and cosmetic cartridge 120 are raised via threaded members on the protrusion 118, applicator member 130, and cartridge 120. For example, the protrusion 118 may be configured to rotate freely within the applicator cover 114, and the applicator member 130 may be raised and lowered by rotating the protrusion 118. That is threads on the inner surface 119 of the protrusion 118 may engage with threads 132 on the outer surface 130 of the applicator member 130 to raise and lower the applicator member 130 through the protrusion 118. Further, inner threads 138 of the applicator member 130 may engage with outer threads 129 of the cartridge 120 to advance and retract the cartridge 120 through the applicator member 130 by rotating a portion of the applicator member 130.

Thus, various cartridges 120 may be raised and lowered based on which cartridge 120 is disposed in the center positioner 212. Further, cosmetics 122 may be easily applied using the applicator member 130 by actuating the cartridges 120 through the applicator member 130. In another embodiment, the applicator member 130 may be completely removable from the protrusion 118 to be used independently as a cosmetic applicator. After using the applicator member 130 independently, the applicator member 130 may again be connected to the housing 110 via the applicator protrusion 118.

The multiple cosmetic holder and applicator 100 may further comprise a top cover 150 that closes the applicator end 102 to protect the cosmetics when not in use. The top cover 150 may further add to the overall aesthetic appearance of the applicator 100.

Figure 4:
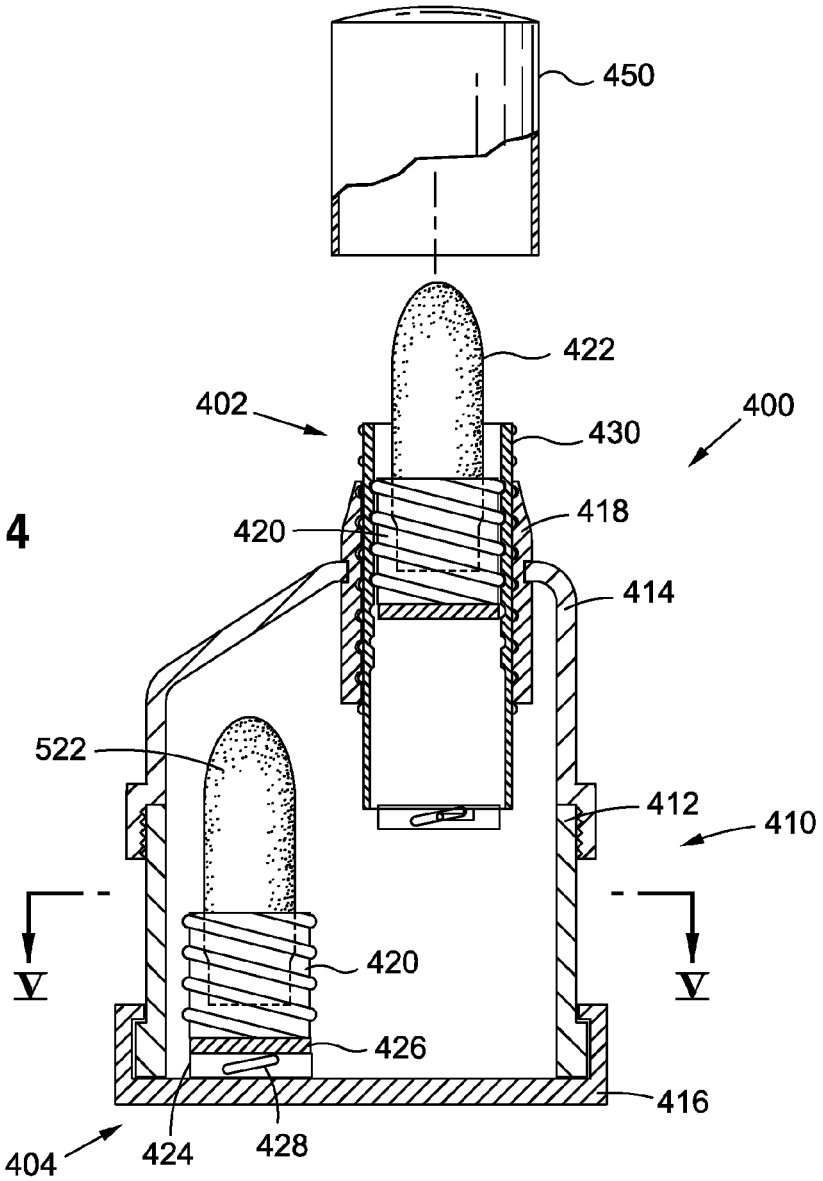
FIG. 4 shows a multiple cosmetic holder and applicator according to another exemplary embodiment.

FIG. 4 shows a multiple cosmetic holder and applicator according to another exemplary embodiment. A number of features in this embodiment are similar to the embodiment shown in FIGS. 1-3C, and thus a detailed explanation of such similar features will be omitted.

In FIG. 4, a multiple cosmetic holder and applicator 400 is shown that has an applicator end 402 and a base end 404. The cosmetic holder and applicator 400 includes a housing 410 that houses a plurality of cosmetic cartridges 420.

The housing 410 includes an outer shell 412 that wraps around an outer circumference of the housing 410. The housing 410 further includes a base cover 416 and an applicator end cover 414. The base cover 416 may be permanently or removably attached to the outer shell 412 and is configured to rotate relative to the outer shell 412. The plurality of cosmetic cartridges 420 may be accessed to be removed or replaced with another cosmetic cartridge 420 via the applicator end cover 414.

In this embodiment, the plurality of cosmetic cartridges 420 are disposed in a circular arrangement within the housing 410. The applicator end cover 414 includes an applicator protrusion 418 that is disposed radially off-center such that the position of the protrusion 418 corresponds with a radial position of the plurality of cosmetic cartridges 420. The protrusion 418 allows a cosmetic cartridge 420 to pass through for application of a cosmetic 422 by a user in a similar manner as described above.

Figure 5:
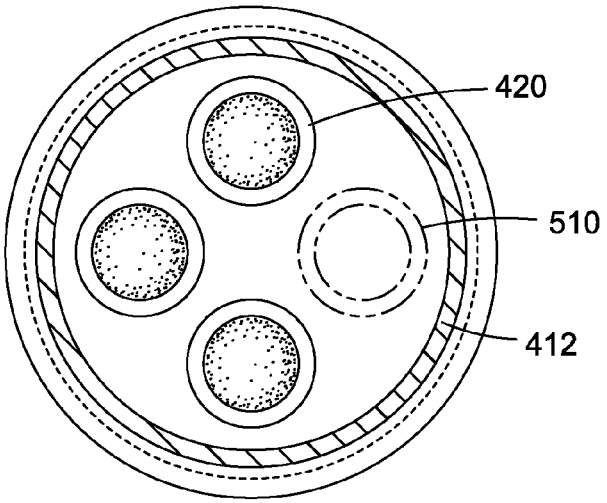
FIG. 5 shows a top section view of the multiple cosmetic holder and applicator of FIG. 4.

FIG. 5 is a top section view of the multiple cosmetic holder and applicator of FIG. 4. As shown in FIG. 4, the housing 410 includes a plurality of cartridge positioners 510. The cartridge positioners 510 are configured to hold a cosmetic cartridge 420 in place. Each of the cosmetic cartridges 420 removably holds a cosmetic 422 such as a lipstick, pencil, sponge, a liquid container, or the like.

In this embodiment, with the rotatable base cover 416 and the off-center protrusion 418, any of the cosmetic cartridges 420 with the cosmetic 422 may be rotated to be positioned in line with the protrusion 418. The base cover 416 may include mechanical bias or the like to temporarily lock into position each time a cartridge positioner 510 is in line with the protrusion 418.

The multiple cosmetic holder and applicator 410 further includes a movable applicator member 430. The applicator member 430 may be of a cylindrical shape and is configured to move relative to the housing 410 through the applicator protrusion 418 to transport cosmetic cartridges 420 into position for application of the cosmetic 422, and to be removed without a cosmetic cartridge 420 to allow the user to manipulate the cosmetic cartridges 420 within the housing 410 by rotating the base cover 416.

Other modifications may also be possible. For example, in the above embodiments, the applicator member is removed and inserted to and from the applicator through one end of the applicator. However, the applicator may also be configured such that the applicator member may be removed from both ends of the applicator. That is, an additional opening may be disposed on the base end such that the applicator member may remove a cosmetic from both the base end and the applicator end.

Figure 6A:
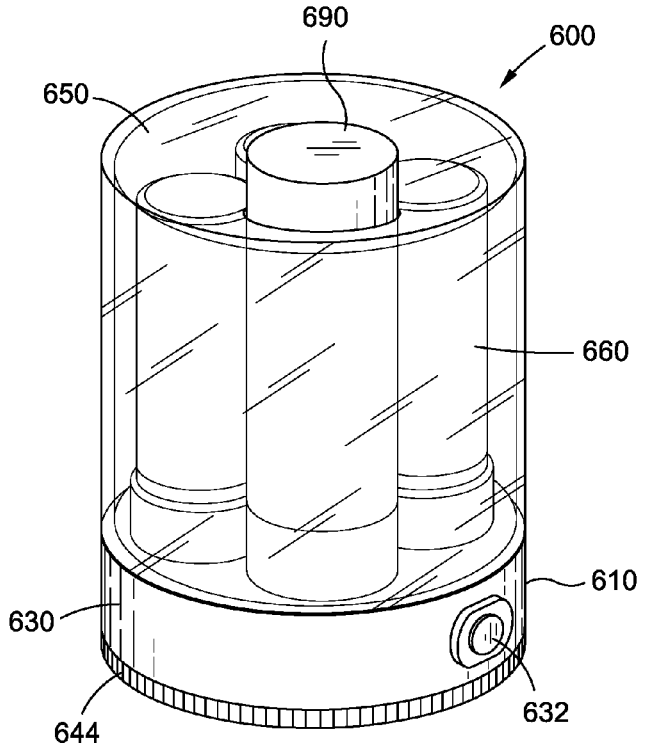
FIG. 6A shows a perspective view of a multiple cosmetic holder and applicator according to another exemplary embodiment.
Figure 6B:
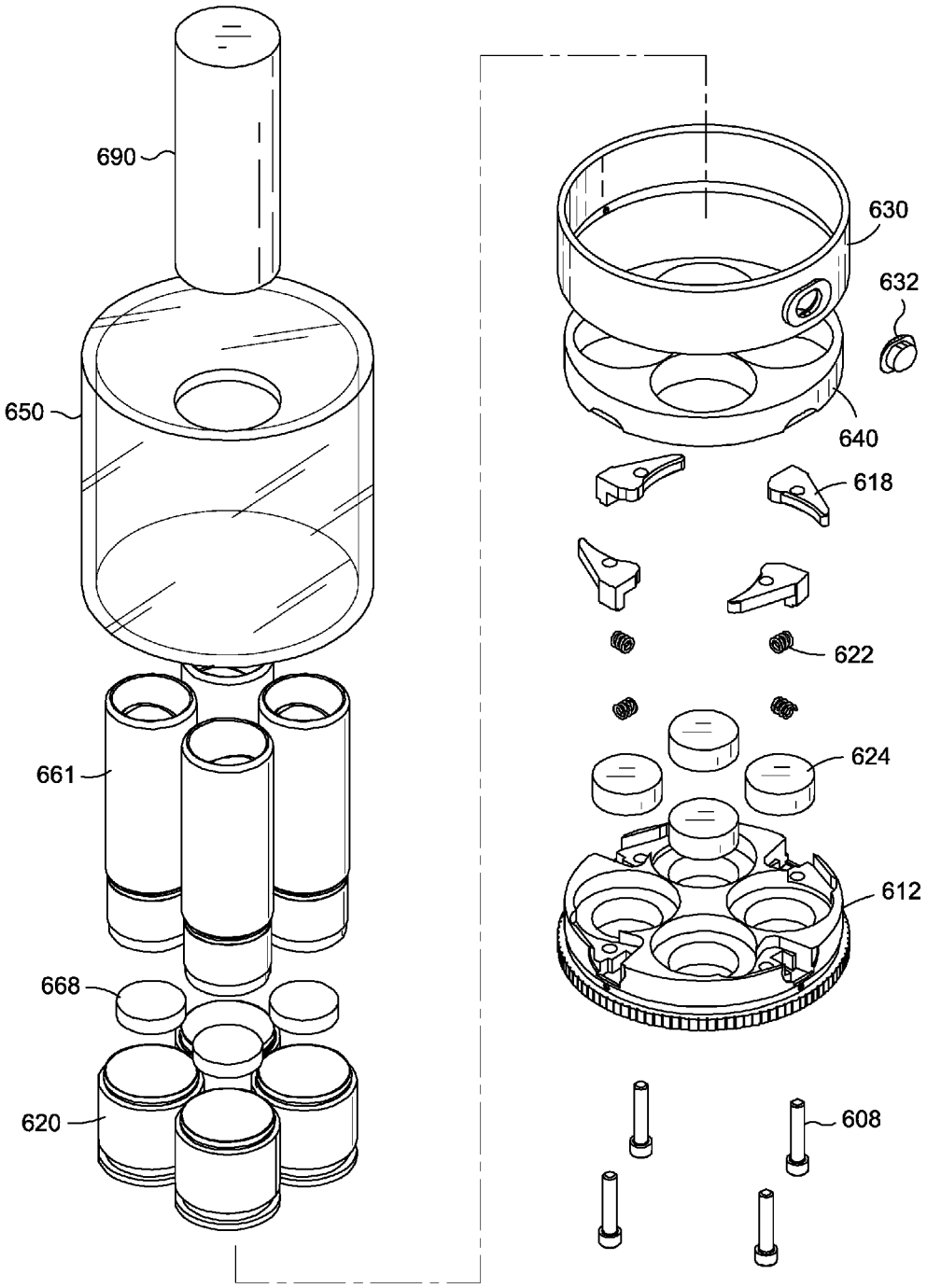
FIG. 6B shows an exploded view of the cosmetic holder shown in FIG. 6A.

A multiple cosmetic holder and applicator according to yet another embodiment is shown in FIGS. 6A and 6B. The cosmetic holder 600 generally includes a main body 610, a cap 650, spaces for holding a plurality of cosmetics 661, and a selector tube 690.

Figure 7:
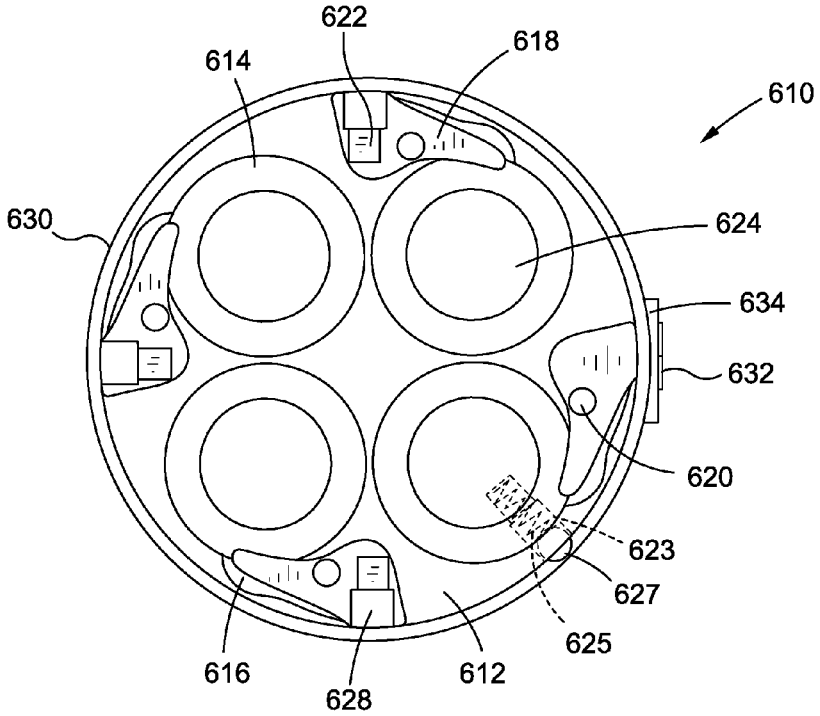
FIG. 7 shows a top view of a main body of a cosmetic holder according to one exemplary embodiment.

The main body 610 comprises an outer case 630, a main body top 640 and a base 612. FIG. 7 shows a top view of the base and outer case according to one exemplary embodiment. The base 612 is the primary hub for the cosmetic holder 600. The base 612 houses all the moving components of the assembly. The base 612 comprises a plurality of cylindrical depressions 614 formed into the top surface of the base 612. The depressions 614 are configured to hold a cosmetic as will be explained in more detail below. In the present embodiment, there are four depressions 614. However, any number of depressions 614 may be incorporated based on the size of the cosmetics to be held therein and the overall desired size of the cosmetic holder 600.

The base 612 further comprises lever cutouts 616 each adjoining a depression 614. The lever cutouts 616 are formed in the base 612 to accommodate movement of a locking lever 618. The locking lever 618 is disposed within the lever cutouts and is configured to rotate about a pin 620. The locking lever 618 is biased in a locking position (explained below) by way of a spring 622. The spring 622 is a compression spring and is abutted against a downward projection 628 of the lever 618.

A lower magnet 624 is disposed within the depressions 614. For example, the lower magnet 624 may be attached to the lower surface of the depression 614 by way of an adhesive, or the lower magnet 624 may be snap-fitted or force-fitted into the depression 614.

A hollowed-out portion 623 may be included which houses a positioning spring 625 biasing a ball 627 outwards from the cylindrical wall of the base 612. The ball 627 is configured to seat the base 612 in one of a plurality of positions relative to the outer case 630.

Figure 8:
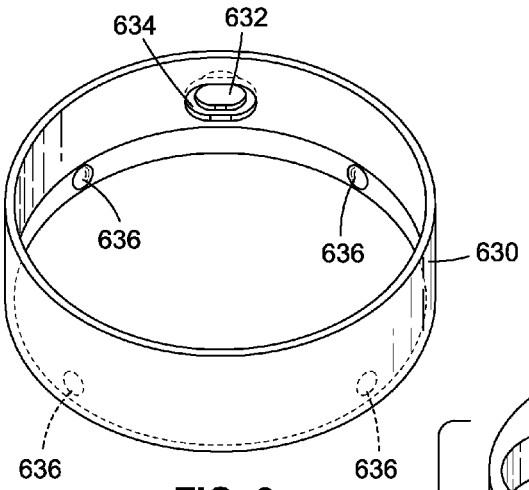
FIG. 8 shows a perspective view of an outer case of a main body of a cosmetic holder according to one exemplary embodiment.

The outer case 630 is disposed to surround the outer cylindrical surface of the base 612. FIG. 8 discloses an example of an outer case according to one exemplary embodiment. The outer case 630 is a cylindrical member configured to surround the base 612. The outer case 630 may be assembled with the main body 610 to rest on a flange 644 (FIG. 10) of the base 612. The outer case 630 comprises a projection 634 on an outer face thereof which houses a button 632. The button 632 is configured to interact with the downward projection 628 of the lever 618 to unlock a cosmetic, as will be described in more detail below.

The outer case 630 further comprises a plurality of depressions 636. The depressions 636 are configured to receive the ball 627. Specifically, when the outer case 630 is moved relative to the base 612 such that the ball 627 aligns with one of the depressions 636, the ball 627 is biased into the depression 636 by way of the spring 623. The interaction between ball 627 and the depression 636 provides the tactile feedback for a user that the button 632 of the outer case 630 is properly aligned to deploy one of the cosmetics, as explained below.

Figure 9:
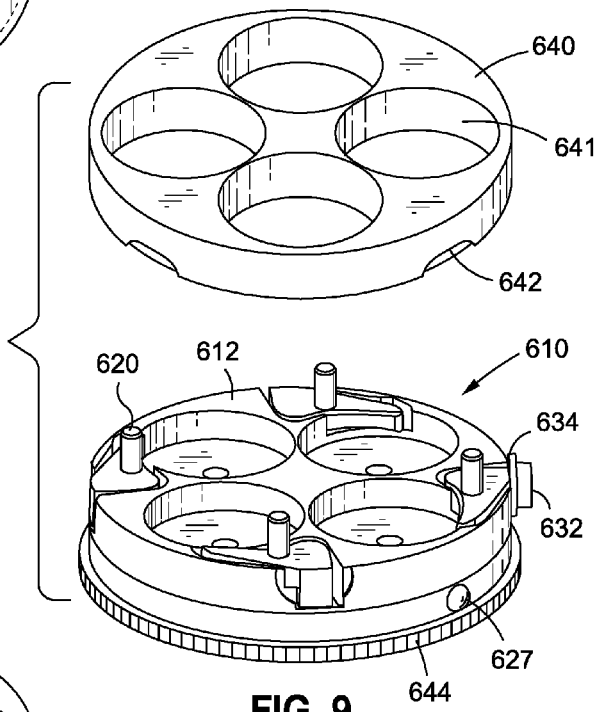
FIG. 9 shows a perspective view of a base and top body of a main body of a cosmetic holder according to one exemplary embodiment.

The main body 610 further comprises a main body top 640. FIG. 9 discloses an example of a main body top above a base according to one exemplary embodiment. The main body top 640 is attached to the base 612 via fasteners such as screws 608 (FIG. 6B). In some embodiments, the fasteners 608 and the pins 620 may be the same part to reduce the number of components. The top 640 is configured to cover the moving parts of the base 612. The top 640 includes a plurality of apertures 641 that correspond with the depressions 614 in the base 612. In this embodiment, cutouts 642 are also included to correspond with the downward projections 628 of the levers 618 to allow for easy actuation of the projections 628.

Figure 10:
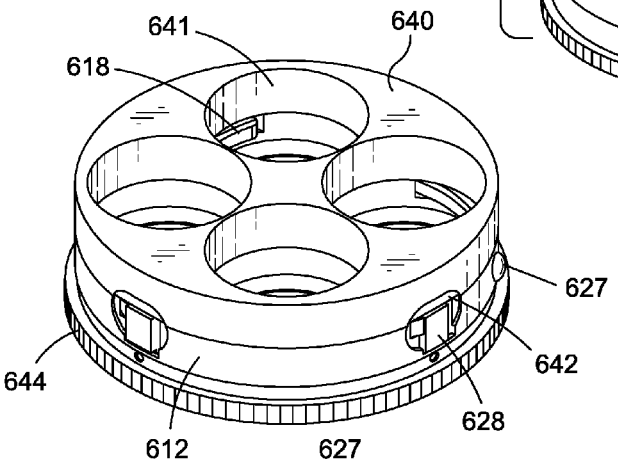
FIG. 10 shows a perspective view of the assembled base and top body shown in FIG. 9.

An example of the base and main body top assembled is shown in FIG. 10. Here, the top 640 is disposed over and assembled to the base 612. In this embodiment, the downward projections 628 project outward from the cutouts 642. Levers 618 can be seen to extend into the cylindrical space defined by the depression 614 and apertures 641.

Figure 11:
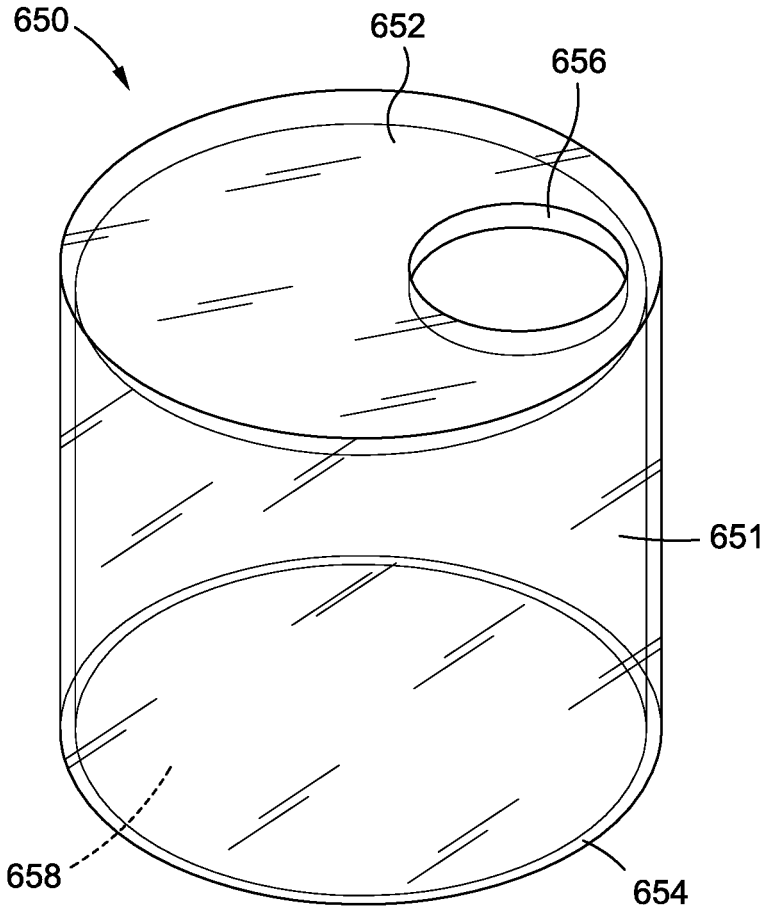
FIG. 11 shows a cap for a cosmetic holder according to one exemplary embodiment.

FIG. 11 shows a cap of a cosmetic holder, according to one exemplary embodiment. Here, a cap 650 includes a cylindrical body 651 having a closed top side 652 and a bottom side 654 with an opening 658. The top 652 includes an aperture 656 to facilitate the removal and replacement of a cosmetic. In some embodiments, the aperture 656 may include a sealing member, such as a rubber o-ring, on the annular surface of the aperture 656 to seal against a selector tube 690 (FIG. 6A). In other embodiments, the top surface 652 of the cap 650 may include a second panel rotatable relative to the top surface 652 that includes a similar aperture as the aperture 656. When the selector tube 690 is removed from the holder 600, the second panel may be rotated so that the similar aperture and the aperture 656 do not align in order to prevent any cosmetics therein from drying out.

The cap 650 is configured to attach to the main body 610 in use. Specifically, the cap 650 may be disposed around the main body top 640 of the main body 610 and above the outer case 630. The cap 650 is configured to be removable from the main body 610 to allow access to the main body 610. For example, the cap 650 may screw onto the main body 610, may slip on over a ridged portion on the main body 610, or the like. In other embodiments, the cap 650 may be removable via a button or other mechanism to release the cap 650 from the main body 610. For example, the cap 650 may include a hinge on one side and may flip open via a locking mechanism on the other side. It is also noted that the cap 650 may take on any one of a variety of shapes other than the shape shown according to design preferences.

Figure 12A:
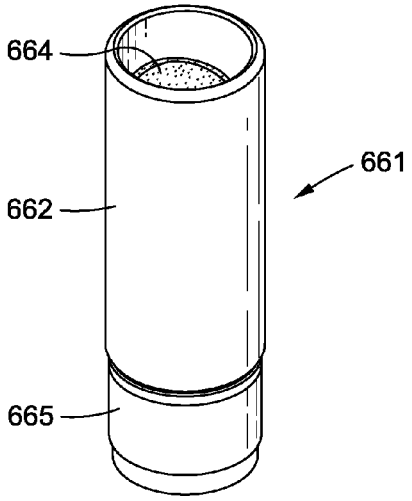
FIG. 12A shows an exemplary standard cosmetic to be held by a cosmetic holder.
Figure 12B:
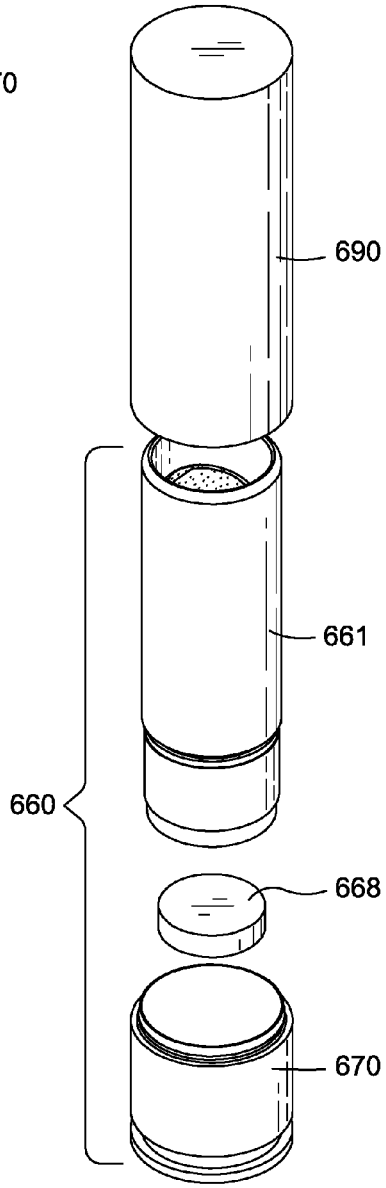
FIG. 12B shows an exploded view of a removable cosmetic assembly, according to one exemplary embodiment.

FIGS. 12A and 12B show a cosmetic and an exploded view of the cosmetic, cosmetic cartridge, and selector tube according to one exemplary embodiment. The cosmetic 661 may include a housing 662 that stores the cosmetic product 664. The cosmetic 661 may also include an actuator 665 for dispensing the cosmetic product 664. The housing 662, cosmetic product 664, and actuator 665 may be a standard cosmetic commercially available such as lipstick, lip gloss, mascara, lip and eye liners, lip balms, lotions, or the like.

Figure 13:
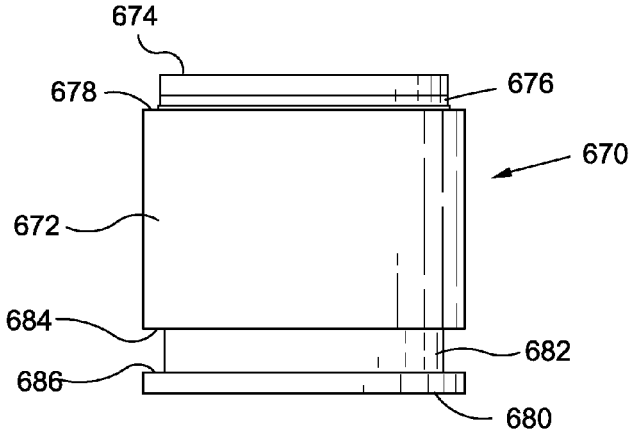
FIG. 13 shows a cartridge for a removable cosmetic assembly, according to one exemplary embodiment.

A cosmetic cartridge 670 is provided to hold the standard cosmetic 661 therein. One exemplary embodiment of a cosmetic cartridge is shown in FIG. 13. The cosmetic cartridge 670 is has a cylindrical housing 672 configured with an open top 674 to accommodate the actuator 665 of the cosmetic housing 662. In one embodiment, the cartridge 670 may include an adjustable receptor within the open top 674 to receive standard cosmetics 661 of different sizes. The cylindrical body 672 comprises an annular groove 682 inset from the cylindrical body 672 defined by horizontal upper and lower locking surfaces 684, 686. The groove 682 and locking surfaces 684,686 interface with the lever 618 to the lock the cartridge within the depression 614 of the base 612.

An upper magnet 668 may be disposed within the cartridge 670 near a bottom edge 680 thereof. The upper magnet 668 is configured to center and position the cartridge within the depression 614 by being attracted to the lower magnet 624 in the base 612. The combination of the standard cosmetic 661, upper magnet 668, and cartridge 670 may be referred to as the removable cosmetic 660 to be held within the cosmetic applicator 600.

A selector tube 690 is configured to cover the removable cosmetic 660. In this embodiment, the selector tube 690 may removably lock to the cartridge 670 by way of a small lip 676 on the cartridge 670. That is, the selector tube 690 uses a friction slip lock to removably lock into place by its interaction with the lip 676.

An exemplary process for using the above described cosmetic holder 600 will now be described. With the holder 600 in the position shown in FIG. 6A, a user may grip the protruding selector tube 690 and pull it outward from the cap 650. The removable cosmetic 660 will remain fixed to the base via the interaction between the lever 618 protruding into the annular groove 682. The force of the pulling will overcome the friction slip locking interaction between the selector tube 690 and lip 676. That is, the lever 618 is biased into the groove 682 by way of the biasing spring 622 which causes the lever 618 to rotate into the groove 682 about the pin 620, thereby preventing removal of the cosmetic 660 when the selector tube 690 is pulled from the cap 650.

With the selector tube 690 removed, the base 612 may be moved relative to the outer case 630 and cap 650. That is, the user may grip the flange 644 of the base 612 and the outer case 630 and cap 650, and rotate the base 612 relative to the outer case 630 and cap 650. This allows the button 632 to move into a position corresponding to one of the protruding downward projections 628. The downward projections 628 each correspond with one of the removable cosmetics 660 housed in the device 600. The interaction between the outer casing 630 and base 612 facilitates that the case "seats" into position corresponding to the downward projections 628 so that the user may easily align the case 630 and the base 612. That is, the ball 627 is biased into one of the depressions 636 when the button 632 is properly aligned with the downward projection 628.

Once the case 630 and button 632 are aligned with the desired removable cosmetic 660, the user may reinsert the selector tube 690 to reengage with the lip 676 of one of the cartridges 670. To remove the desired removable cosmetic 660, the user may engage/press the button 632 disposed on the outer case 630 to disengage the lever 618 from the annular groove 682. In this embodiment, the actuation of the button 632 forces the downward projection 628 inward against the biasing spring 622. This in turn rotates the lever 618 about the pin 620 so that the end of the lever 618 disengages from the groove 682.

While the button 632 is pressed, the user pulls the selector tube 690 from the cap 650. Because the lever 618 is not locked with the cartridge 670, the friction between the selector tube 690 and the lip 676 keeps the selector tube 690 and cartridge 670 attached as the selector tube 690 is pulled from the cap 650. The friction between the selector tube 690 and the lip 676 is configured to be sufficient to overcome the magnetic force between the upper magnet 668 and the lower magnet 624. Once removed, the user may remove the selector tube 690 from the cartridge 670 to apply the cosmetic 661. Note that the cartridge 670 may be firmly attached to the standard cosmetic 661 in order to apply the cosmetic 661 without removing it from the cartridge 670.

Once the user is finished with the removable cosmetic 660, the user may reattach the selector tube 690 to the cartridge 670. Then the user slides the joined tube 690 and cartridge 670 back through the aperture 656 of the cap and into the depression 614 of the base 612. The bottom surface of the cartridge 670 and/or the outer surface of the lever 618 may be formed such that the force from the reinsertion of the cartridge biases the lever 618 against the spring 622 to allow the cartridge 670 to lock into position without the need to press the button 632. For example, a top surface of the lever may be constructed in an arched manner with a rounded edge. The attraction between the upper magnet 668 and the lower magnet 624 helps to guide the cartridge 670 into the correct centered position in the depression 614. Once in the locked position, the lever 618 will reengage with the groove 682 by way of the biasing spring 622. The process may be repeated to access any one of the removable cosmetics 660 in the device 600.

Other modifications of the cosmetic holder 600 are also possible. For example, instead of moving one selector tube 690 to the desired removable cosmetic 660, the cap 650 may have an aperture for each removable cosmetic 660, and a tube 690 may be provided for each cosmetic 660. In another modification, the main body 610 may include a plurality of buttons corresponding to each cosmetic 660. The main body 610 and cap 650 may be configured so that the cap 650 is movable relative to the entire main body 610. In other examples, both of the above described modifications may be included simultaneously so that any one of the cosmetics 660 may be removed and reinserted as desired without any rotation of any part of the device.

In addition, while the disclosed embodiments show an upper magnet 668 and a lower magnet 624, only one magnet may also be used. For example, the cartridge 670 may be constructed at least partially from a magnetically attracted material that is attracted by the lower magnet 624. Alternatively, the upper magnet 668 may be placed in the cartridge 670 and may be magnetically attracted to a material placed within the depressions 614.

Figure 14A:
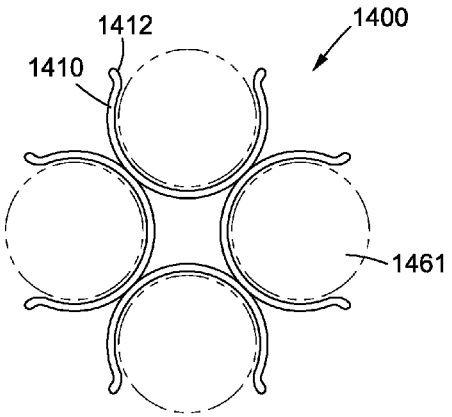
FIG. 14A shows a top view of a multiple cosmetic holder and applicator according to one exemplary embodiment.
Figure 14B:
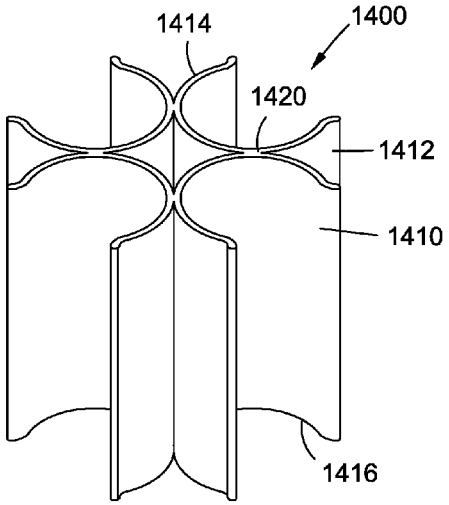
FIG. 14B shows a perspective view of the cosmetic holder of FIG. 14A.

Another embodiment of a multiple cosmetic holder and application is shown in FIGS. 14A and 14B. In this embodiment, a cosmetic holder 1400 includes a plurality of open, c-shaped slots 1410. The slots 1410 are configured to hold a standard cosmetic 1461. The cosmetic 1461 may be a lipstick, eyeliner, pencil, brush, lip gloss, lip balm, or the like. The slot is formed from a flexible material such that the standard cosmetic may snap fit into place. To facilitate placement of the cosmetic 1461 into the slots 1410, the outside edges 1412 of the c-shaped slots 1410 may be flared as shown. The cosmetic 1461 may also be placed by sliding the cosmetic 1461 from a top 1414 or a bottom 1416 of the slot 1410 and into the slot 1410. In some embodiments, flanges may be included on the top 1414 or bottom 1416 of the slot to prohibit sliding of the cosmetic 1461 in one direction or the other.

In this embodiment, there are four c-shaped slots which are connected via a joint 1420, such as a weld, solder, or adhesive extending from the top 1414 of the holder 1400 to the bottom 1416. However, other connections now known or later developed between the slots 1410 may be possible. In other embodiments, the slots 1410 may extend from a solid center portion. Further, any number of slots may be used such as three, five, or more than five. The number and size of the slots 1410 may vary depending on the type of cosmetic to be held and the size and number of cosmetics desired.

Figure 15:
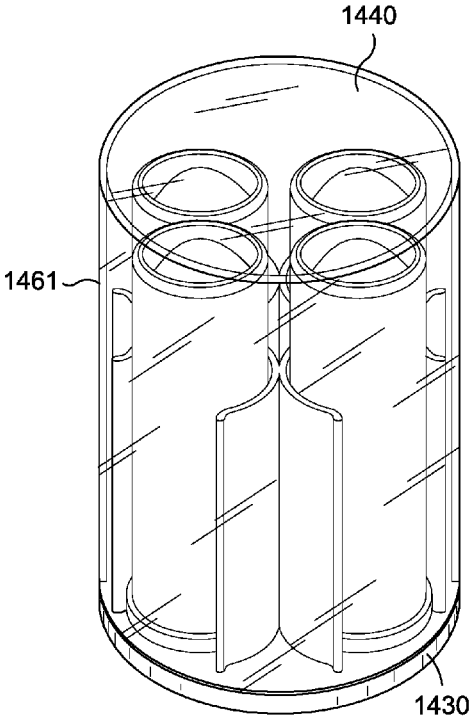
FIG. 15 shows the cosmetic holder shown in FIGS. 14A and 14B with a base and cap, according to one exemplary embodiment.

An example of the cosmetic holder with a cap and base is shown in FIG. 15. In FIG. 15, the cosmetic holder 1400 is mounted to a base 1430. In some instances, it is desirable to cover a cosmetic in an air-tight container to preserve the cosmetic. Accordingly, a cap 1440 may be provided to connect with the base 1430. Of course, the standard cosmetics 1461 may each have their own cover, and the cap 1440 may be omitted.

Figure 16:
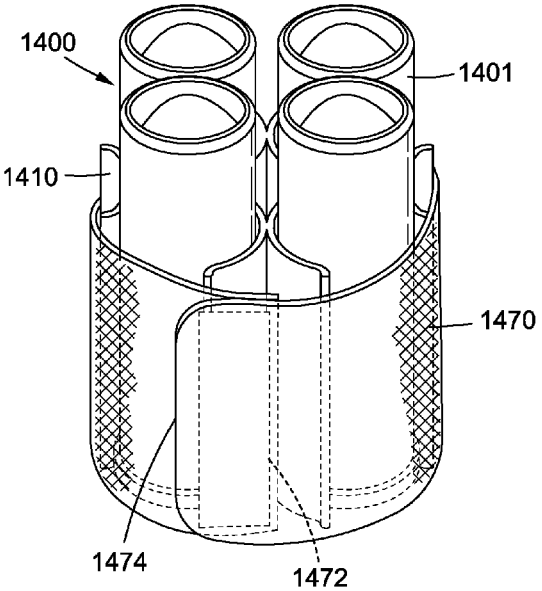
FIG. 16 shows the cosmetic holder shown in FIGS. 14A and 14B with a belt, according to one exemplary embodiment.

An example of the cosmetic holder with a belt is shown in FIG. 16. Here, a belt 1470 may have a first side 1474 attached to the slots 1410. The belt is configured to wrap around the holder 1400 and connect via a fastener 1472. For example, corresponding magnets may be placed in the belt. A hook and corresponding slot, a snap, or any other fastening device may be used. The belt 1470 gives the holder 1400 an enhanced appearance and further secures the cosmetics 1461 within the slots 1410. Here, the belt 1470 is shown to have a width that is substantially equal to the height of the slots 1410. However, the belt 1470 may have a width that is less than the height of the slots 1410. This may allow the user to easily slide a cosmetic 1461 through the slots 1410 even without removing the belt 1470.

The cosmetics 1461 within the holder 1400 may be accessed in a number of ways. In one example, a user may remove the desired cosmetic 1461 from the slot 1410 via the flexible material of the slot 1410. Then the user may reinsert the cosmetic 1461 after use. In another example, the user may advance or slide the cosmetic 1461 within the slot 1410 so that the cosmetic protrudes higher than the holder and the other cosmetics in order to use the cosmetic.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A multiple cosmetic holder and applicator comprising:

at least one cosmetic cartridge, the cosmetic cartridge comprising a cylindrical body having an opening to receive a standard cosmetic, an upper lip protruding from the cylindrical body, an upper magnet disposed within the opening, and a lower annular groove on the cylindrical body;

a main body configured to hold the at least one cosmetic cartridge, the main body comprising:

a base having at least one depression in which a lower magnet is disposed, the at least one depression being configured to receive the at least one cosmetic cartridge therein, at least one locking mechanism disposed adjacent to the at least one depression, the at least one locking mechanism configured to interface with the lower annular groove of the cartridge to selectively lock the cartridge within the depression, and an outer case disposed around the base and movable relative to the base to at least one predetermined position, the outer case comprising a pressable button which when pressed interfaces with the at least one locking mechanism to unlock the locking mechanism from the annular groove;

a cap disposed on the main body that is configured to cover the main body, the at least one cosmetic cartridge, and the standard cosmetic, the cap comprising an aperture in the top surface thereof; and a selector tube configured to extend through the aperture and over a selected standard cosmetic, the selector tube interfacing with the upper lip of the cartridge in a friction fit to remove the cartridge with the selected standard cosmetic when the button is pressed and the locking mechanism is unlocked.

2. The multiple cosmetic holder and applicator according to claim 1, wherein the upper magnet centers the cartridge within the depression via a magnetic force with the lower magnet disposed in the base.

3. The multiple cosmetic holder and applicator according to claim 1, wherein the main body further comprises a main body top disposed above the base, the main body top covering the locking mechanism, and the main body top comprising at least one aperture corresponding to the at least one depression within the base.

4. The multiple cosmetic holder and applicator according to claim 1, wherein the locking mechanism is a lever configured to rotate about a pin.

5. The multiple cosmetic holder and applicator according to claim 4, wherein the lever comprises a downward projection and extends outward from the main body, the button being configured to actuate the downward projection to move the lever.

6. The multiple cosmetic holder and applicator according to claim 5, wherein the locking mechanism further comprises a biasing spring, the biasing spring configured to bias the downward projection towards an outer surface of the base, and to rotate the lever into a locked position within the annular groove.

7. The multiple cosmetic holder and applicator according to claim 1, wherein a number of cartridges is four, and wherein the cap is removable.

8. The multiple cosmetic holder and applicator according to claim 1, wherein the base further comprises a cutout disposed in an outer surface of the base, a seating spring disposed within the cutout, and ball bearing disposed within the cutout, the outer case comprises at least one indent along an inner surface thereof, and the ball bearing is biased outward against the inner surface of the outer case to bias the ball bearing into the at least on indent.

9. The multiple cosmetic holder and applicator according to claim 1, wherein the standard cosmetics comprise one or more of a lipstick, lip gloss, lip balm, pencil, brush, or liner.

10. A multiple cosmetic holder and applicator comprising:

at least one cosmetic cartridge, the cosmetic cartridge comprising a cylindrical body having an opening to receive a standard cosmetic;

a main body configured to hold the at least one cosmetic cartridge, the main body comprising at least one locking mechanism configured to interface with the cartridge to selectively lock the cartridge on the main body, a cap disposed on the main body that is configured to cover the main body, the at least one cosmetic cartridge, and the standard cosmetic, the cap comprising an aperture in the top surface thereof; and a selector tube configured to extend through the aperture and over a selected standard cosmetic, the selector tube interfacing with the cartridge to selectively remove the cartridge with the selected standard cosmetic.

11. The multiple cosmetic holder and applicator of claim 10, wherein the main body comprises a base and a main body top, the main body top disposed over the base and moveable relative to the base, the cap configured to attach to the main body top.

12. The multiple cosmetic holder and applicator of claim 11, wherein main body top and the cap rotate relative to the base to align the aperture with the selected standard cosmetic.

13. The multiple cosmetic holder and applicator of claim 10, wherein the at least one cosmetic cartridge comprises a lower annular groove, the at least one locking mechanism interfaces with the lower annular groove to selectively lock the cosmetic cartridge.

14. A method of storing and using a plurality of cosmetics, the method comprising: providing a multiple cosmetic holder and applicator comprising:

at least one cosmetic cartridge, the cosmetic cartridge comprising a cylindrical body having an opening to receive a standard cosmetic, an upper lip protruding from the cylindrical body, an upper magnet disposed within the opening, and a lower annular groove on the cylindrical body;

a main body configured to hold the at least one cosmetic cartridge, the main body comprising:

a base having at least one depression in which a lower magnet is disposed, the at least one depression being configured to receive the at least one cosmetic cartridge therein, at least one locking mechanism disposed adjacent to the at least one depression, the at least one locking mechanism configured to interface with the lower annular groove of the cartridge to selectively lock the cartridge within the depression, and an outer case disposed around the base and movable relative to the base to at least one predetermined position, the outer case comprising a pressable button which when pressed interfaces with the at least one locking mechanism to unlock the locking mechanism from the annular groove;

a cap disposed on the main body that is configured to cover the main body, the at least one cosmetic cartridge, and the standard cosmetic, the cap comprising an aperture in the top surface thereof; and a selector tube configured to extend through the aperture and over a selected standard cosmetic, the selector tube interfacing with the upper lip of the cartridge in a friction fit to remove the cartridge with the selected standard cosmetic when the button is pressed and the locking mechanism is unlocked;

removing the selector tube from the cosmetic holder and applicator while the at least one cosmetic cartridge is locked within the at least one depression;

moving the outer case and the cap relative to the base a selected predetermined position corresponding to the selected standard cosmetic;

inserting the selector tube over the selected standard cosmetic and engaging the selector tube with the upper lip of the at least one cartridge receiving the selected standard cosmetic;

engaging the pressable button to unlock the at least one cartridge receiving the selected standard cosmetic;

removing the selected standard cosmetic from the multiple cosmetic holder and applicator via the friction fit between the selector tube and the upper lip;

removing the selector tube from the cartridge and applying the standard cosmetic; and reengaging the selector tube with the cartridge and replacing selector tube and cartridge into the aperture of the cap and the depression of the base.

15. The method of claim 14, wherein the locking mechanism is a lever configured to rotate about a pin.

16. The method of claim 15, wherein the lever comprises a downward projection and extends outward from the main body, the button being configured to actuate the downward projection to move the lever.

17. The method of claim 16, wherein the locking mechanism further comprises a biasing spring, the biasing spring configured to bias the downward projection towards an outer surface of the base, and to rotate the lever into a locked position within the annular groove.

18. The method of claim 14, wherein a number of cartridges is four.

19. The method of claim 14, wherein the base further comprises a cutout disposed in an outer surface of the base, a seating spring disposed within the cutout, and ball bearing disposed within the cutout, the outer case comprises at least one indent along an inner surface thereof, and the ball bearing is biased outward against the inner surface of the outer case to bias the ball bearing into the at least on indent.

20. The method of claim 14, wherein the standard cosmetics comprise one or more of a lipstick, lip gloss, lip balm, pencil, brush, or liner.

* * * * *